US006079419A

United States Patent [19]

Perlsweig

[11] Patent Number: 6,079,419

[45] Date of Patent: Jun. 27, 2000

[54] NON-VISIBLE CLIP FOR HEAD COVERING

[76] Inventor: Leon Perlsweig, 23017 Gainford St., Woodland Hills, Calif. 91364

[21] Appl. No.: 09/198,239

[22] Filed: Nov. 23, 1998

[51] Int. Cl.[7] ..... A42B 7/00

[52] U.S. Cl. ..... 132/60; 132/201; 132/53; 132/277

[58] Field of Search ..... 132/201, 53, 54, 132/55, 277, 279, 275, 57.1, 60, 63.1, 64.1, 66.1; 2/920, 300; 24/342.1, 326, 334

[56] References Cited

U.S. PATENT DOCUMENTS

| | | | |
|---|---|---|---|
| 644,894 | 3/1900 | Carlin | 24/342.1 |
| 2,165,716 | 7/1939 | Molleson | 132/53 |
| 2,651,310 | 9/1953 | Selson | 132/53 |
| 3,474,798 | 10/1969 | Tillptson | 132/53 |
| 3,714,670 | 2/1973 | Pollack et al. | 2/197 |
| 3,980,092 | 9/1976 | Garufi | 132/53 |
| 4,277,864 | 7/1981 | Orson, Jr. | 24/342.1 |
| 4,406,296 | 9/1983 | Wexler et al. | 132/275 |
| 4,991,236 | 2/1991 | Pritchett | 2/189 |
| 4,993,079 | 2/1991 | Johnson | 2/181 |
| 5,137,037 | 8/1992 | Mochizuki | 132/53 |
| 5,204,994 | 4/1993 | Herzberg et al. | 2/199 |
| 5,303,724 | 4/1994 | Anzivino | 132/53 |
| 5,501,239 | 3/1996 | Walker | 132/53 |
| 5,675,841 | 10/1997 | Jackson | 2/175.7 |

*Primary Examiner*—Todd E. Manahan
*Attorney, Agent, or Firm*—Baker Botts L.L.P.

[57] ABSTRACT

A clip assembly for securing a head cover, such as a skullcap, to the head of the wearer, comprises a spring loaded hairclip having a segment of Velcro® closure permanently affixed to one arm of the hairclip. The opposite side of the closure is coated with an adhesive covered by peelable release paper. In use, one or more of the clip assemblies are adhesively attached to the inner surface of the head covering within its outer periphery, so as not to be visible when the head covering is worn. When the head covering is placed on the head, the clips are opened, the free arm of the clip inserted into the hair of the wearer and then released to grasp the hair. The clip may be separated from the head covering at the Velcro® closure to be available for use on the other head coverings.

11 Claims, 1 Drawing Sheet

NON-VISIBLE CLIP FOR HEAD COVERING

This invention relates to head coverings and more particularly to means for securing a head covering, such as a skullcap, to the head of a wearer such that the securing means is not visible when the head covering is worn.

BACKGROUND OF INVENTION

Certain types of head coverings are small relative to the head of the wearer or do not firmly surround the head. If not secured in some fashion to the head, such small head coverings can easily fall off when the head is tilted or moved suddenly or if exposed to a gust of wind. Chinstraps are known to retain hats on the heads of wearers, but these are often uncomfortable and unattractively visible. Other expedients have also been proposed, such as one or more pieces of one half of a Velcro® closure attached to a band tied around the wearer's head, with the hat having mating halves of the closure affixed to the inner band of the hat, as in U.S. Pat. No. 4,993,079. Obviously, such an arrangement is applicable only to hats or caps which completely surround the head of the wearer.

When the head covering is small relative to the head of the wearer, such as a skullcap or yarmulka, the problem of retaining the covering on the head is particularly acute. Typically, the wearer resorts to a bobby pin or hairclip to grasp the edge of the skullcap along with the wearer's hair to retain the skullcap in position. While the use of hair clips in this fashion is effective in retaining the head covering on the head of the wearer, it suffers from the disadvantages that the clip is visible when in place and thus, aesthetically lacking, and further, that the clip is separable from the skullcap and easily lost or misplaced.

In U.S. Pat. No. 5,204,494, an arrangement to overcome the first of these shortcomings is disclosed. A pocket formed on the interior side of the skullcap receives one arm of the hairclip so that when the clip is inserted and closed to grasp the hair of the wearer, it is not visible on the exterior of the skullcap. While solving the aesthetic problem, this arrangement has other drawbacks. Firstly, creation of the pocket or pockets requires additional manufacturing steps which add considerably to the cost of what ordinarily is a relatively inexpensive item and secondly, since the clip is completely separate, it is still subject to being lost or misplaced.

It is the object of the present invention to provide a means for securing a head covering, such as a skullcap or yarmulka, to the head of the wearer with a hairclip that is not visible when in place, remains firmly connected to the head covering when the latter is removed, can be readily and removably affixed to any head covering and is inexpensive and simple to fabricate.

SUMMARY OF THE INVENTION

In accordance with the invention, a hairclip assembly comprises a conventional spring-loaded hairclip and a small segment of Velcro® closure, one side of which is cemented on or sewn to the outer side of one arm of the spring clip. The other side of the Velcro® closure is coated with an adhesive covered with a peelable release paper. To attach the assembly to the head covering, the release paper is peeled off and the adhesive surface firmly pressed against the inner surface of the head covering sufficiently within its perimeter so that the hairclip is entirely beneath the head covering. One or more hairclip assemblies may be used on a single head covering, as desired.

BRIEF DESCRIPTION OF THE DRAWINGS

The invention will be more fully understood and appreciated from the following detailed description thereof, when taken in conjunction with the appended drawings in which.

DETAILED DESCRIPTION OF THE INVENTION

Figure 3:
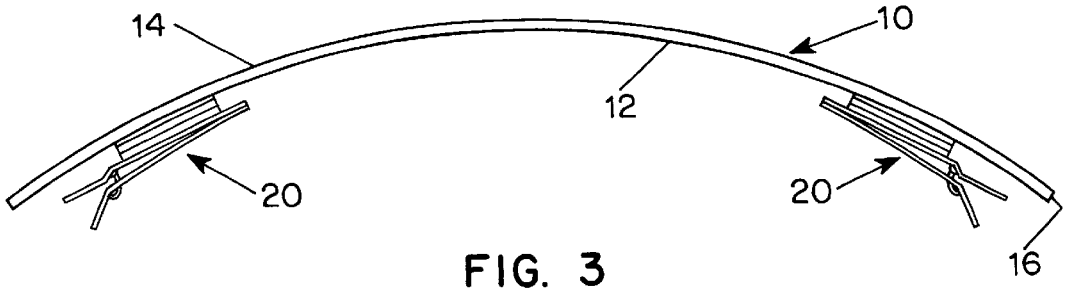
FIG. 3 is a cross-section through a skullcap showing two hairclip assemblies of the invention attached to the inner surface.
Figure 4:
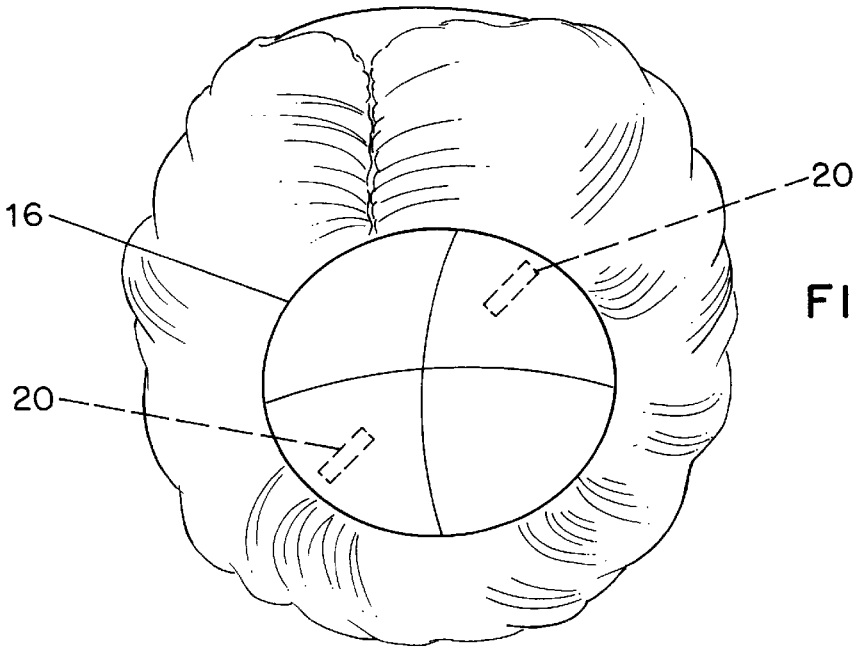
FIG. 4 is a view looking down on the head of a wearer showing a skullcap held in place by two hairclip assemblies of the invention.

Turning first to FIGS. 3 and 4, a head covering 10, here shown as a skullcap or yarmulka, made of any suitable material such as cloth or leather, has an inner surface 12, an outer surface 14 and a periphery 16, in this embodiment generally circular in shape. Attached to the inner surface of the skullcap 10 are a pair of hairclip assemblies 20 spaced diametrically opposite to one another and totally within the periphery 16. As will be explained in more detail below, the skullcap is affixed to the head of the wearer by engaging the hairclips forming part of the assemblies 20, with the hair of the wearer, thereby securing it to the head, as shown in FIG. 4. Although two hairclip assemblies are shown in the illustrated embodiment, one or more such assemblies spaced as desired, may be used in accordance with the invention.

Figure 1:
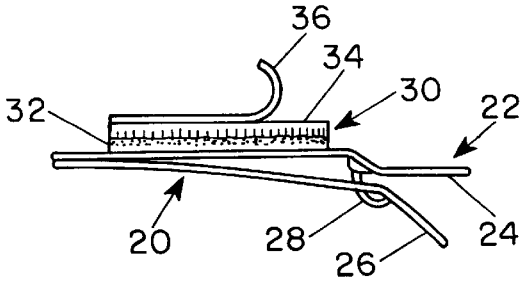
FIG. 1 is a side view of the hairclip assembly of the invention.
Figure 2:
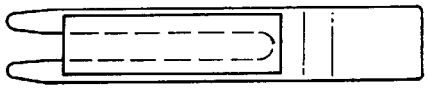
FIG. 2 is a top view of the hairclip assembly.

The structure of the hairclip assembly 20 of the invention is shown in FIGS. 1 and 2. It includes a conventional two-arm hairclip 22 commonly used by women for holding strands of hair in a desired configuration. The arms 24, 26 of the hairclip 20 are arranged in overlapping relationship and coupled to each other near one end by a spring-loaded pivot 28. The ends of the arms 24, 26 beyond the pivot 28 are bent or curved outwardly with respect to each other so that when squeezed together between the fingers, the arms 24, 26 are spread apart. The construction and use of such hairclips are well known and need not be further described.

Affixed to one arm of the hairclip 22 is one half of a segment of a two-piece releasable attachment means 30, preferably of the type identified by the trademark "Velcro". As is well known, a Velcro® closure comprises a first piece of material 32 one surface of which is covered with loops and a second piece of material 34 with one surface covered by flexible hooks. When the hooks and loops are manually pressed together, they firmly, but releasably, engage to hold the two pieces of material together.

Referring again to FIGS. 1 and 2, the smooth surface of one piece 32 of the attachment means 30 is permanently secured to the outer side of an arm 24 of the clip 22, such as by an adhesive. The mating piece 34 is provided with an adhesive, such as contact cement, on its smooth surface, covered by a peelable release paper 36.

In use, the release paper 36 is removed from the clip assembly and the exposed adhesive surface firmly pressed against the inner surface of the skullcap. The assembly is positioned sufficiently inward of the periphery of the skullcap so that it is not visible when the skullcap is worn, yet close enough for the wearer to reach the divergent ends of the hairclip with the fingertips. As the skullcap is placed on the head of the wearer, he or she opens the clip or clips, inserts the free arm of the clip into the hair and then releases it, thereby firmly engaging the clip, and the attached skullcap, to the head of the wearer.

The clip assembly preferably would be made available as a kit, for attachment to the skullcap by the wearer. A plurality of upper Velcro® strips 34 may be packaged with a single clip assembly, the extra strips being available for attachment to additional skullcaps, so that a single clip may be used with a number of skullcaps.

Alternatively, a skullcap may be manufactured with the clip assemblies in place, in which case the upper Velcro® segment or segments 34 are attached by the manufacturer, either by an adhesive or by sewing.

It will be understood that although a Velcro® closure is the preferred means of releasably attaching the clip to the skullcap, other releasable fasteners, such as snaps, hooks and eyes, etc. may be employed. Similarly, various types of spring-loaded hair clips maybe used without departing from the spirit of the invention.

It will also be apparent, that while particularly adaptable for use with skullcaps, the invention may be used with other types of head coverings. Accordingly, the scope of the invention is to be limited only by the appended claims.

I claim:

1. A device for securing a hat to the head of the wearer, comprising:

a hairclip having two spring-loaded arms adapted to clamp to hair on the head of the wearer when closed and manually spreadable to engage the hair of the wearer when spread apart;

releasable attachment means having first and second parts releasably secured to each other;

said first part being adapted to be permanently attached to the inner surface of the hat within its periphery, and said second part being permanently secured to one of the arms of said hairclip;

whereby when said hat is secured to the head of the wearer by said device, said device is entirely beneath the hat.

2. The device of claim 1 wherein one of said first and second parts of said attachment means comprises a surface covered with flexible loops and the other of said parts comprises a surface covered with flexible hooks, said loops and hooks on said respective surfaces being releasably engageable with each other when manually pressed together.

3. A device for securing a hat to the head of the wearer, comprising:

a hairclip having two spring-loaded arms adapted to clamp to hair on the head of the wearer when closed and manually spreadable to engage the hair of the wearer when spread apart;

releasable attachment means having first and second parts releasably secured to each other;

said first part being adapted to be permanently attached to the inner surface of the hat within its periphery, and said second part being permanently secured to one of the arms of said hairclip by an adhesive;

whereby when said hat is secured to the head of the wearer by said device, said device is entirely beneath the hat.

4. A device for securing a hat to the head of the wearer, comprising:

a hairclip having two spring-loaded arms adapted to clamp to hair on the head of the wearer when closed and manually spreadable to engage the hair of the wearer when spread apart;

releasable attachment means having first and second parts releasably secured to each other;

an adhesive on one surface of said first part, and a sheet of release material covering said adhesive, said first part being adapted to be permanently adhesively attached to the inner surface of said hat within its periphery upon removal of said sheet of release material;

said second part being permanently secured to one of the arms of said hairclip by an adhesive;

whereby when said hat is secured to the head of the wearer by said device, said device is entirely beneath the hat.

5. In combination, a head covering adapted to be worn on the head of the wearer;

a hairclip having two spring-loaded spreadable arms for engaging the hair on the head of the wearer; and a two-part releasable attachment means, one part comprising a piece of looped material and the other part comprising a corresponding piece of hooked material, one part of said attachment means being secured to the inner surface of said head covering within its periphery and the other part being secured to the uppermost surface of one arm of said hairclip.

6. The combination of claim 5, wherein said head covering is a skullcap having a generally circular outer periphery and shaped to conform to the head of the wearer.

7. The combination of claim 5, wherein said attachment means is adhesively secured to the inner surface of said head covering.

8. A kit for adapting a plurality of head coverings to be separately secured to the head of the wearer, said kit comprising:

a hairclip having two spring-loaded arms adapted to clamp to hair on the head of the wearer when closed and manually spreadable to engage the hair of the wearer when spread apart; and releasable attachment means having a plurality of first parts and a second part, each of said plurality of first parts adapted to be separately releasably secured to said second part;

each of said first parts adapted to be permanently attached to the inner surface of a head covering; and said second part being permanently secured to one of the arms of said hairclip.

9. The kit of claim 8 wherein one of said first and second parts of said attachment means comprises a surface covered with flexible loops and the other of said parts comprises a surface covered with flexible hooks, said loops and hooks on said respective surfaces being releasably engageable with each other when manually pressed together.

10. A kit for adapting a plurality of head coverings to be separately secured to the head of the wearer, said kit comprising:

a hairclip having two spring-loaded arms adapted to clamp to hair on the head of the wearer when closed and manually spreadable to engage the hair of the wearer when spread apart;

releasable attachment means having a plurality of first parts and a second part, each of said plurality of first parts adapted to be separately releasably secured to said second part;

each of said first parts adapted to be permanently attached to the inner surface of a head covering; and said second part being permanently secured to one of the arms of said hairclip by an adhesive.

11. A kit for adapting a plurality of head coverings to be separately secured to the head of the wearer, said kit comprising:

a hairclip having two spring-loaded arms adapted to clamp to hair on the head of the wearer when closed and manually spreadable to engage the hair of the wearer when spread apart;

releasable attachment means having a plurality of first parts and a second part, each of said plurality of first parts adapted to be separately releasably secured to said second part;

an adhesive on one surface of each of said first parts;

a sheet of release material covering the adhesive on said one surface of each of said first parts, each of said first parts adapted to be permanently attached to the inner surface of a head covering; and said second part being permanently secured to one of the arms of said hairclip by an adhesive.

* * * * *